US008438773B2

(12) United States Patent
Carlson et al.

(10) Patent No.: US 8,438,773 B2
(45) Date of Patent: May 14, 2013

(54) ARTICULATING MOUNT FOR WEAPON SIGHT ACCESSORY

(75) Inventors: Mike Carlson, Saline, MI (US); Alan Charlton, Chelsea, MI (US); Fred Collin, Ann Arbor, MI (US); Michael L. Marino, Ann Arbor, MI (US)

(73) Assignee: OptiFlow, Inc., Ann Arbor, MI (US)

( * ) Notice: Subject to any disclaimer, the term of this patent is extended or adjusted under 35 U.S.C. 154(b) by 125 days.

(21) Appl. No.: 13/151,926

(22) Filed: Jun. 2, 2011

(65) Prior Publication Data

US 2011/0296732 A1 Dec. 8, 2011

Related U.S. Application Data

(60) Provisional application No. 61/351,023, filed on Jun. 3, 2010.

(51) Int. Cl.
*F41C 27/00* (2006.01)

(52) U.S. Cl.
USPC ..... 42/90; 42/125

(58) Field of Classification Search ..... 42/90, 124–128
See application file for complete search history.

(56) References Cited

U.S. PATENT DOCUMENTS

| | | | | |
|---|---|---|---|---|
| 944,916 | A | 12/1909 | Shepard | |
| 1,083,288 | A | 1/1914 | Lowe | |
| 1,710,547 | A * | 4/1929 | Meise | 42/124 |
| 2,115,618 | A | 4/1938 | Carl | |
| 2,367,762 | A | 1/1945 | Eiane | |
| 2,385,176 | A | 9/1945 | White | |
| 2,425,130 | A | 8/1947 | Shelley | |
| 2,445,087 | A | 7/1948 | Rogers | |
| 2,451,266 | A | 10/1948 | Whittemore | |
| 2,527,289 | A | 10/1950 | Allen | |
| 2,529,801 | A | 11/1950 | Fisk | |
| 2,545,419 | A | 3/1951 | Williams | |
| 2,571,935 | A | 10/1951 | Pachmayr et al. | |
| 2,597,466 | A | 5/1952 | Felix | |
| 2,629,175 | A | 2/1953 | Merritt | |
| 2,639,507 | A | 5/1953 | Pachmayr | |
| 2,644,237 | A | 7/1953 | Pachmayr | |
| 2,710,453 | A | 6/1955 | Beverly | |
| 2,773,310 | A | 12/1956 | Bircher | |
| 2,803,880 | A | 8/1957 | Weaver | |
| 3,178,823 | A | 4/1965 | Lipski | |
| 3,226,868 | A | 1/1966 | Mahoney | |

(Continued)

FOREIGN PATENT DOCUMENTS

| | | |
|---|---|---|
| DE | 142545 C | 1/1902 |
| GB | 24953 | 10/1909 |
| GB | 468237 | 7/1937 |

*Primary Examiner* — Michael David

(74) *Attorney, Agent, or Firm* — Gifford, Krass, Sprinkle, Anderson & Citkowski, P.C.

(57) ABSTRACT

A mount for mounting an accessory to a weapon has a base portion and an upper portion each with fore-aft axes. A first and a second link interconnect the upper portion and the base portion for articulation between a use position and a storage position. The upper portion in the use position is disposed above the base portion and the upper portion in the storage position is disposed to a side of the base portion. The fore-aft axis of the base portion and the fore-aft axis of the upper portion are parallel to one another in both the use position and in the storage position.

14 Claims, 12 Drawing Sheets

U.S. PATENT DOCUMENTS

| | | | | |
|---|---|---|---|---|
| 3,559,940 | A * | 2/1971 | Kruzell | 42/127 |
| 3,732,642 | A | 5/1973 | Bray | |
| 4,461,087 | A | 7/1984 | Norman | |
| 5,144,752 | A * | 9/1992 | Boeke et al. | 42/126 |
| 5,165,178 | A | 11/1992 | Seely | |
| 5,442,860 | A | 8/1995 | Palmer | |
| 7,013,593 | B2 | 3/2006 | Pettersson et al. | |
| 7,367,152 | B2 | 5/2008 | Samson | |
| 7,369,302 | B2 | 5/2008 | Gaber | |
| 7,730,655 | B2 * | 6/2010 | Spuhr | 42/127 |
| 7,870,688 | B1 * | 1/2011 | Dasiukevich | 42/124 |
| 7,870,689 | B2 | 1/2011 | Dextraze | |
| 7,908,782 | B1 | 3/2011 | LaRue | |
| 8,171,666 | B2 * | 5/2012 | Karagias | 42/124 |
| 2011/0067287 | A1 * | 3/2011 | Collin et al. | 42/119 |
| 2011/0296731 | A1 * | 12/2011 | Carlson et al. | 42/90 |
| 2011/0296732 | A1 * | 12/2011 | Carlson et al. | 42/90 |

* cited by examiner

ARTICULATING MOUNT FOR WEAPON SIGHT ACCESSORY

REFERENCE TO RELATED APPLICATIONS

This utility patent application claims priority from U.S. provisional patent application Ser. No. 61/351,023, filed Jun. 3, 2010, the entire content of which is incorporated herein in its entirety.

FIELD OF THE INVENTION

The present invention relates generally to devices for mounting accessories to a weapon.

BACKGROUND OF THE INVENTION

A weapon such a rifle is often used in combination with one or more accessories, such as a sighting scope and/or accessories for a scope, such as a magnifier or night vision accessory. It is often desirable to quickly position a scope accessory, such as a magnifier into a use position, wherein it is aligned with a scope, when the accessory is needed. Likewise, it is desirable to quickly reposition such an accessory out of the way, or remove the accessory, when it is not needed.

SUMMARY OF THE INVENTION

The present invention provides several embodiments of a mount for mounting an accessory to a weapon. The mount allows an accessory to be moved from a use position wherein the accessory is aligned above the weapon to a storage position wherein the accessory is moved to the side.

According to one embodiment, the mount is for mounting an accessory to a rail on a weapon, the rail defining a longitudinal axis and having an upper face and a pair of opposed side faces. The mount has a base portion with an upper surface and a lower surface. The lower surface is configured to engage a rail of a weapon so as to attach the base portion thereto. The base portion has a forward edge and a rearward edge with a fore-aft axis extending therebetween. The fore-aft axis is parallel to the longitudinal axis of the rail when the base portion is attached to the rail. The mount also has an upper portion with an upper surface and a lower surface. The upper surface of the upper portion defines a mounting surface for receiving an accessory.

A first and a second link interconnect the upper portion and the base portion for articulation between a use position and a storage position. The upper portion in the use position is disposed above the base portion and the upper portion in the storage position is disposed to a side of the base portion. The upper portion has a forward edge and a rearward edge with a fore-aft axis extending therebetween. The fore-aft axis of the base portion and the fore-aft axis of the upper portion are parallel to one another in both the use position and in the storage position.

In some versions, one of the links has an effective length longer than the effective length of the other link. In certain versions, the upper portion is generally parallel to the base portion in the use position and is angled with respect to the base portion in the storage position. In further versions, part of the upper portion extends below the base portion when the upper portion is in the storage position.

Some versions of a mount in accordance with the present invention further include a locking element for locking the upper portion in the use position. The locking element may be a latch that engages a tab on the upper portion, and the latch may be pivotally interconnected with the base portion.

Some versions of a mount further include a spring for biasing the upper portion towards the storage position.

Some versions of a mount in accordance with the present invention have a base portion with a first side portion configured to engage a first side face of a rail of a weapon and an opposite second side portion configured to engage a second side face of a rail of a weapon. One of the side portions is movable relative to the other of the side portions such that the side portions cooperate to selectively grip the rail of the weapon.

A further embodiment of the present invention provides a mount for mounting an accessory to a weapon. The mount has a base portion with an upper surface and a lower surface, the lower surface configured to attach to a weapon. The base portion has a forward edge and a rearward edge with a fore-aft axis extending therebetween. The fore-aft axis is generally parallel to a longitudinal axis of the weapon when the base portion is attached thereto. The mount also has an upper portion with an upper surface and a lower surface, the upper surface of the upper portion comprising a mounting surface for receiving an accessory.

A first and a second link interconnect the upper portion and the base portion for articulation between a use position and a storage position. The upper portion in the use position is disposed above the base portion and the upper portion in the storage position is disposed to a side of the base portion.

The upper portion has a forward edge and a rearward edge with a fore-aft axis extending therebetween. In some versions, the fore-aft axis of the base portion and the fore-aft axis of the upper portion are parallel to one another in both the use position and in the storage position.

DETAILED DESCRIPTION OF THE INVENTION

The present invention provides a mount for mounting an accessory to a rail of a weapon, such as a rifle. The mount allows the accessory to be quickly moved between a use position and a storage position. An example of a rail is shown at 10 in FIG. 1-3. The rail 10 may be said to be elongated and to generally define a longitudinal axis A. The rail may be said to have an upper surface and a pair of opposed side faces. Typically, the rail is provided along an upper surface of a weapon, such as a rifle. While the illustrated rail 10 is typical of rails used on many weapons, the present invention is not limited to this rail design. In addition, embodiments of the present invention may be provided that do not require a rail, but instead attach directly to a weapon in other ways.

Figure 1:
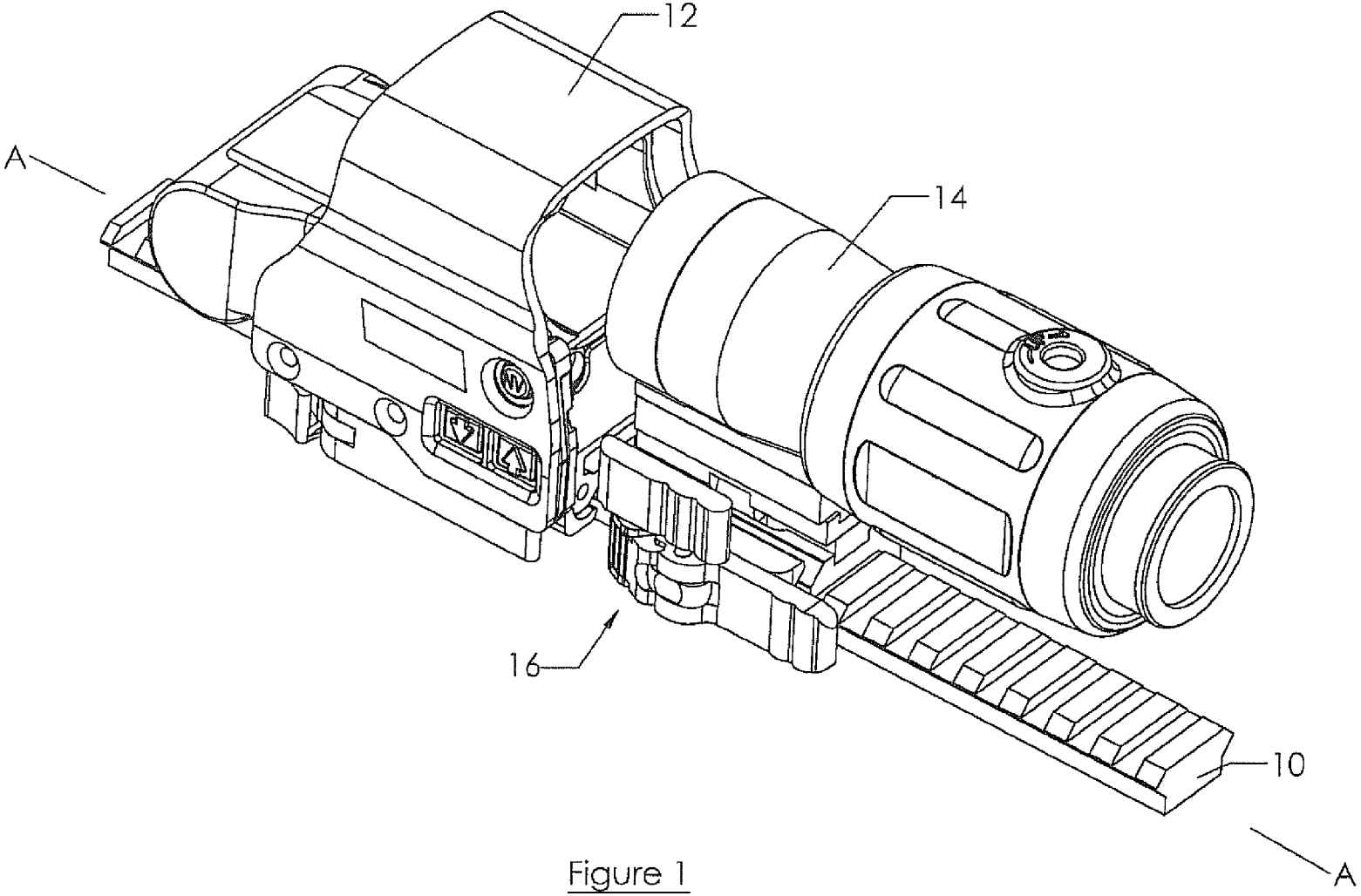
FIG. 1 is a perspective view of a first embodiment of a mount in accordance with the present invention supporting an accessory on a rail, with the mount shown in a use position.
Figure 2:
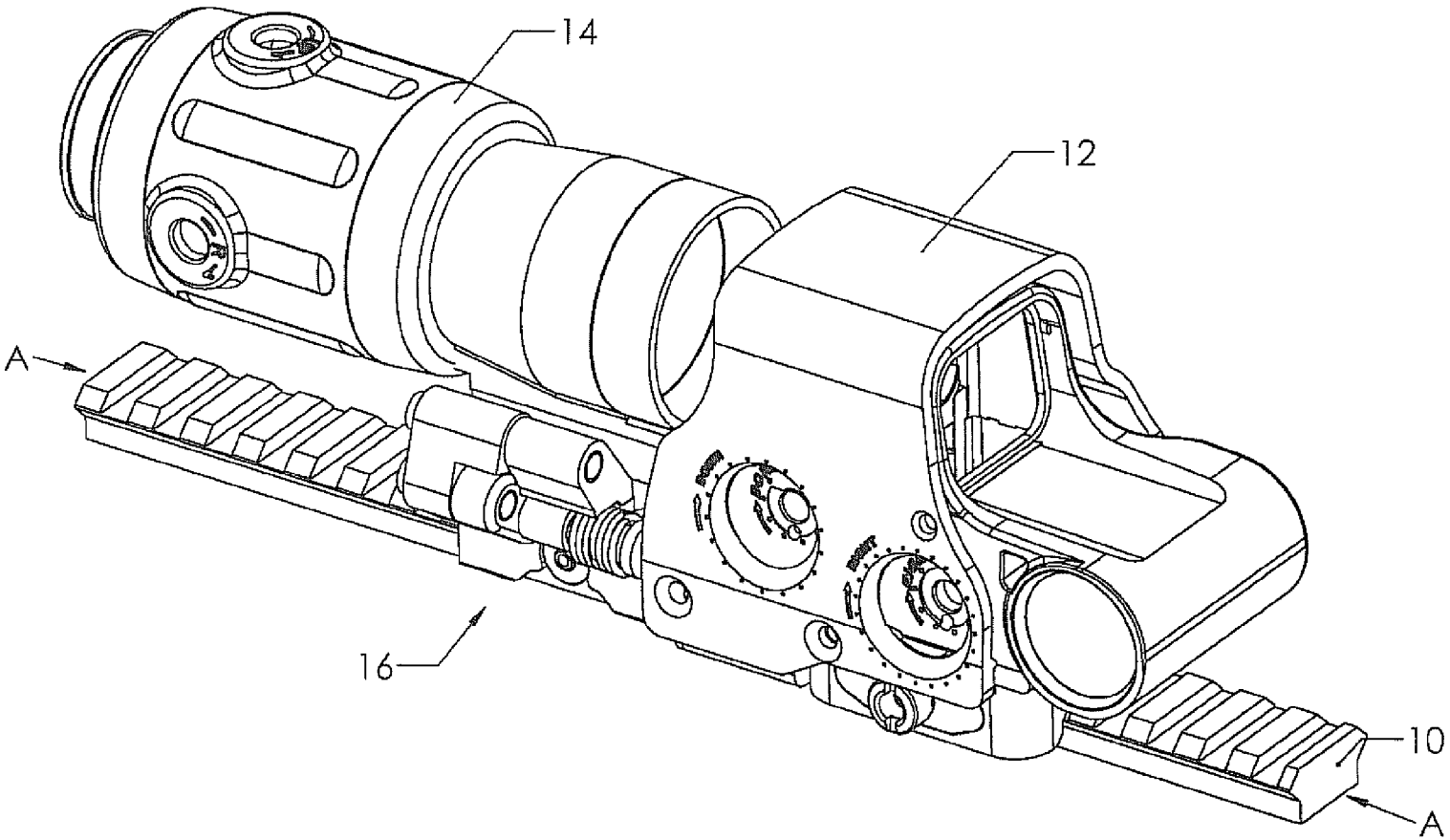
FIG. 2 is a perspective view of the mount and accessory of FIG. 1 from the opposite side.
Figure 3:
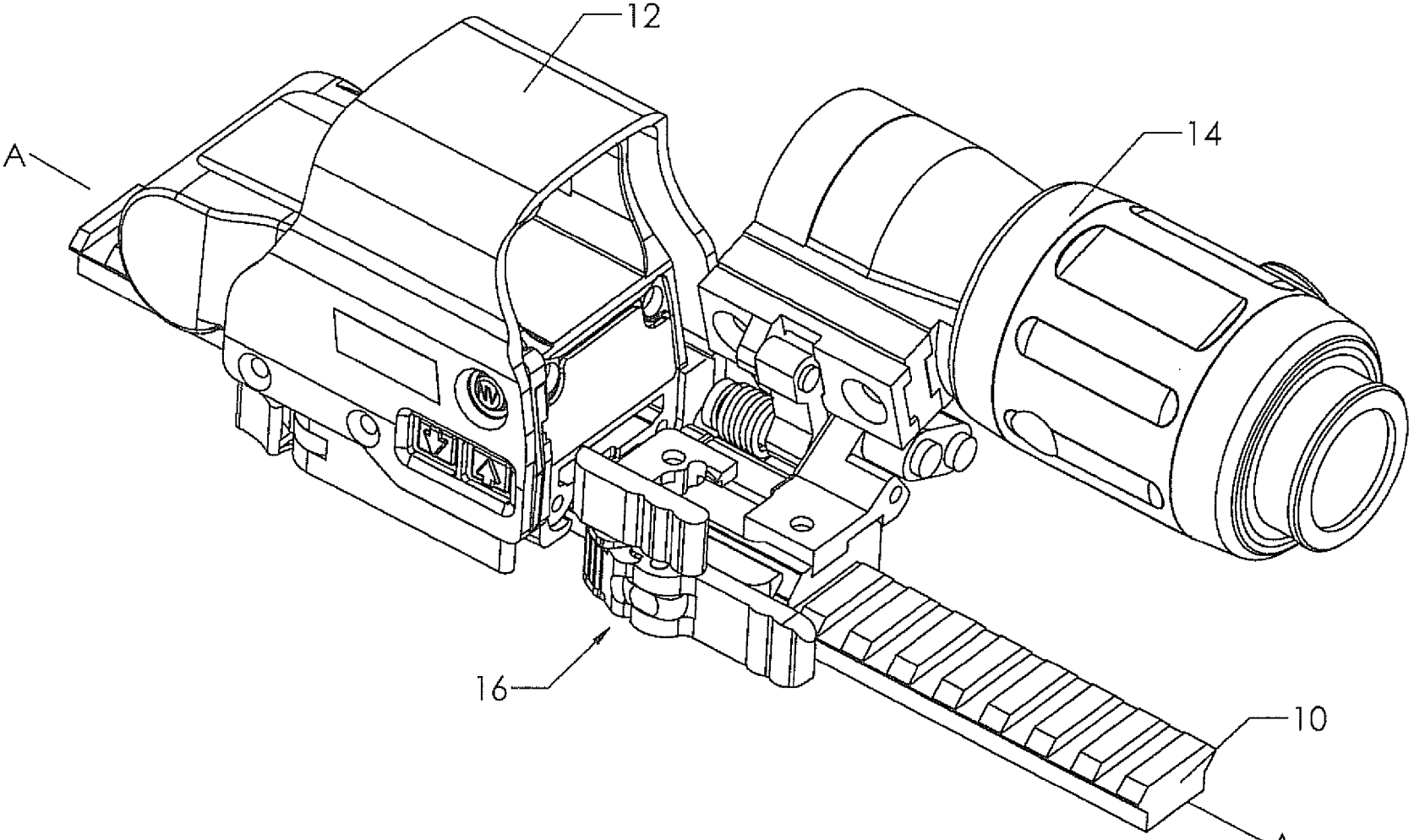
FIG. 3 is a perspective view of the mount and accessory of FIG. 1, with the mount and accessory in a storage position.

Also shown in FIGS. 1-3 is a sighting device 12 that is mounted to the rail 10. The sighting device 12 is merely exemplary and does not form part of the invention. The sighting device 12 may be a scope or laser sight and may be used for targeting purposes. The sighting device 12 may be used alone or in combination with a variety of accessories. One such accessory is shown at 14. The illustrated accessory 14 is a magnifying device for use with the sighting device 12. The accessory 14 does not form part of the present invention but is used therewith. Other accessories, including but not limited to night vision accessories, may be used instead of the illustrated accessory 14. In the illustrated embodiment, the mount is an independent device to which the accessory or components of the accessory are attached. Alternatively, a mount according to the present invention may form a component of an accessory, such as forming part of its base.

A mount according to the present invention may take a variety of forms. A first embodiment of the present invention is shown in FIG. 1-8, with the Figures representing scale drawings of some versions. Other versions may be dimensioned differently than illustrated.

In FIGS. 1 and 2, the accessory 14 is shown in the use position, wherein it is aligned with the sighting device 12 for use therewith. In FIG. 3, the accessory 14 is shown in a storage position wherein it is not aligned with the sighting device 12.

The mount 16 mounts the accessory 14 to the rail 10. The mount 16 has a use position, illustrated in FIGS. 1 and 2, wherein the accessory 14 is in its use position. The mount 16 also has a storage position, illustrated in FIG. 3, wherein the accessory is positioned in the storage position. As shown, when the mount moves to the storage position, the accessory is moved to the side. When the mount is moved to the side, this does not require that the upper portion and/or accessory is moved completely beyond a side edge of the base portion, but that they are moved to the side and may or may not be completely outboard of the respective side edge of the base portion.

Figure 4:
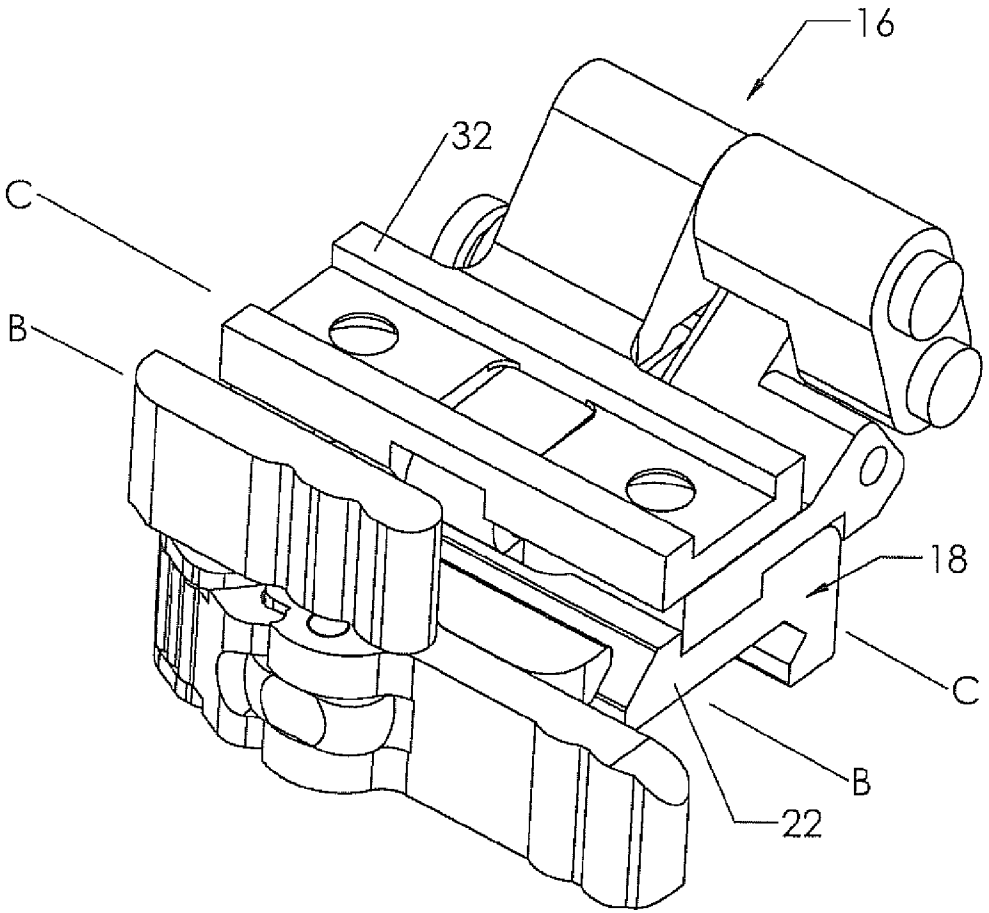
FIG. 4 is a perspective view of the mount of FIG. 1 without the accessory or the rail, with the mount in the use position.
Figure 5:
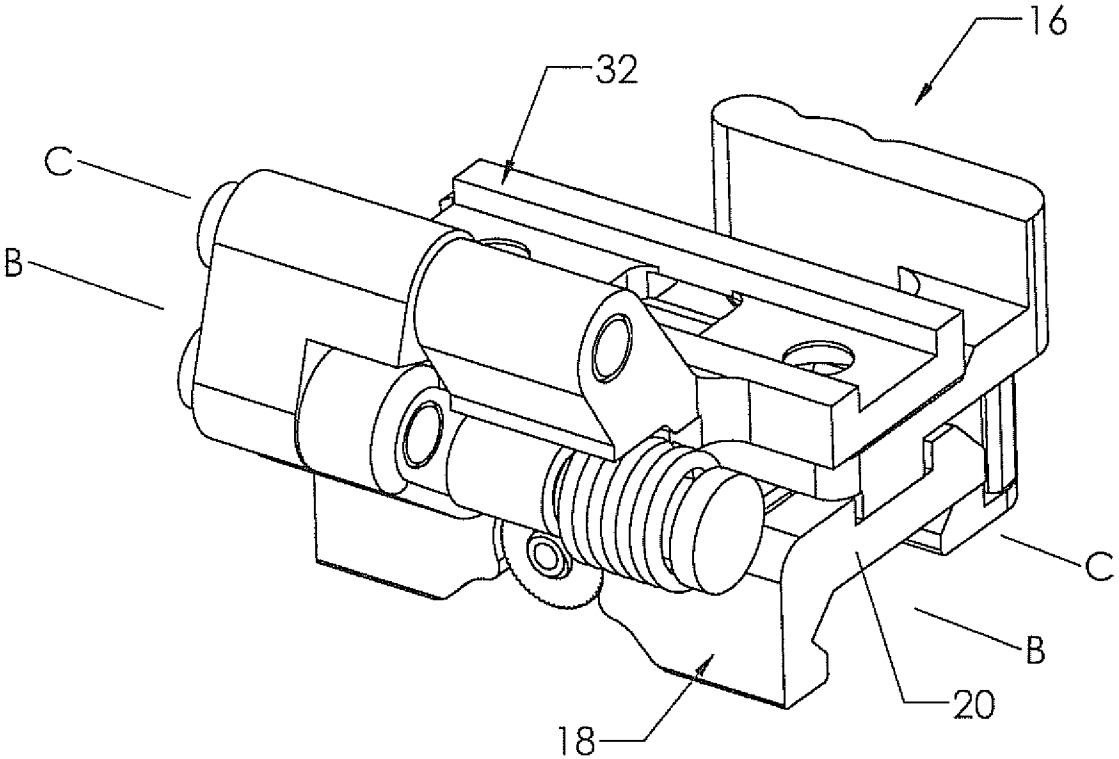
FIG. 5 is a perspective view of the mount of FIG. 4 from the opposite side.
Figure 6:
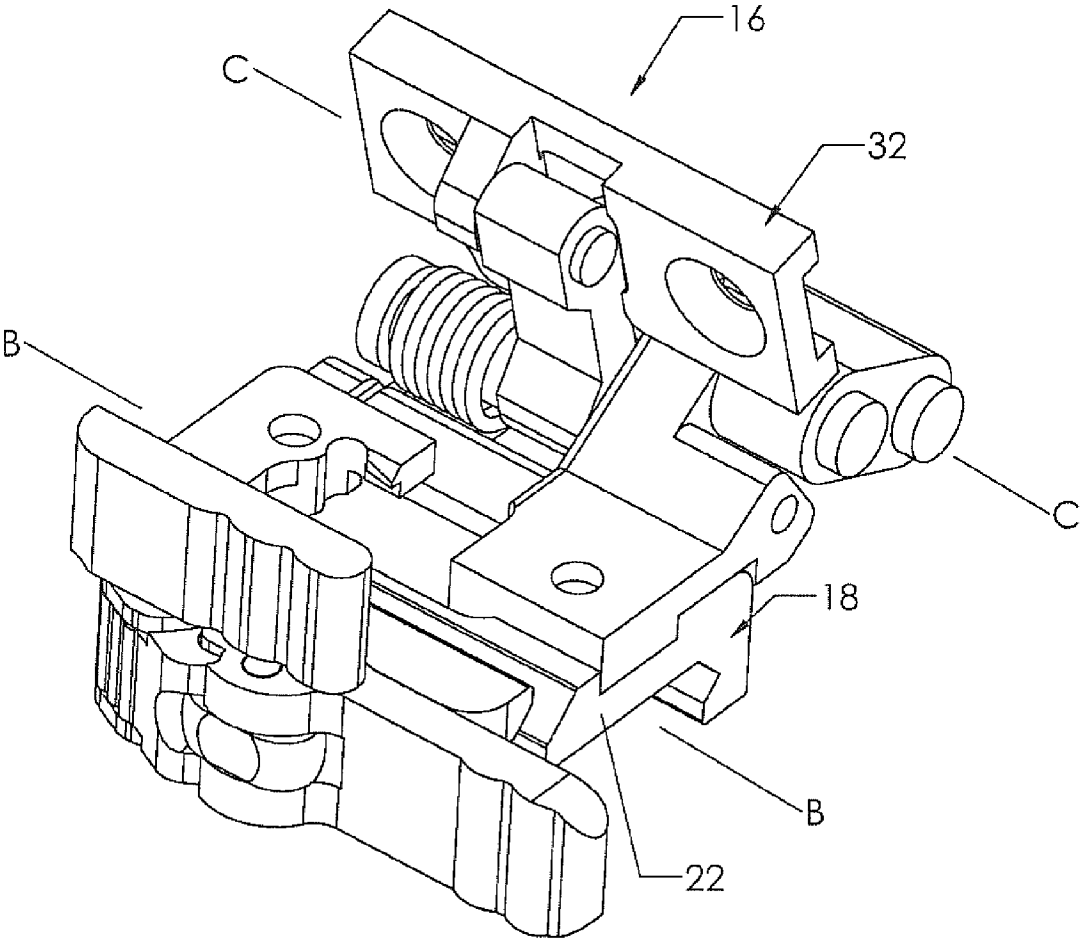
FIG. 6 is a perspective view of the mount of FIG. 4, with the mount in the storage position
Figure 7:
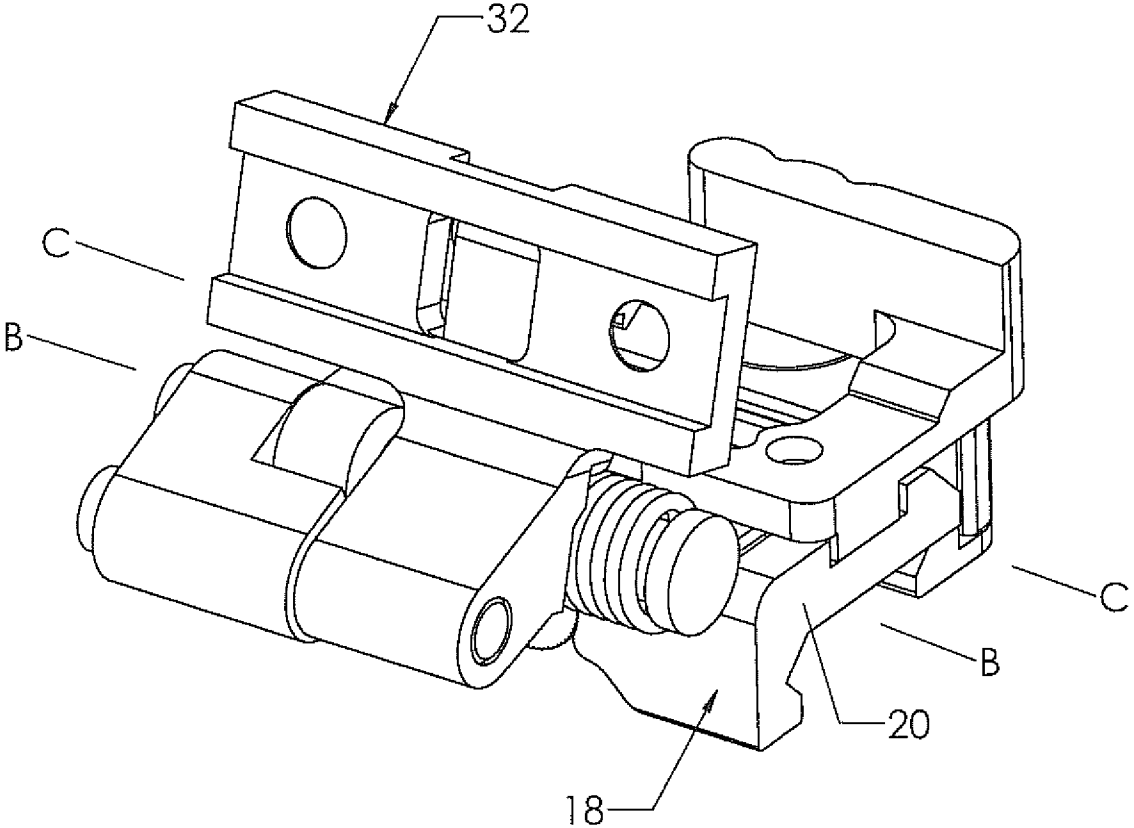
FIG. 7 is a perspective view of the mount of FIG. 6 from the opposite side.
Figure 8:
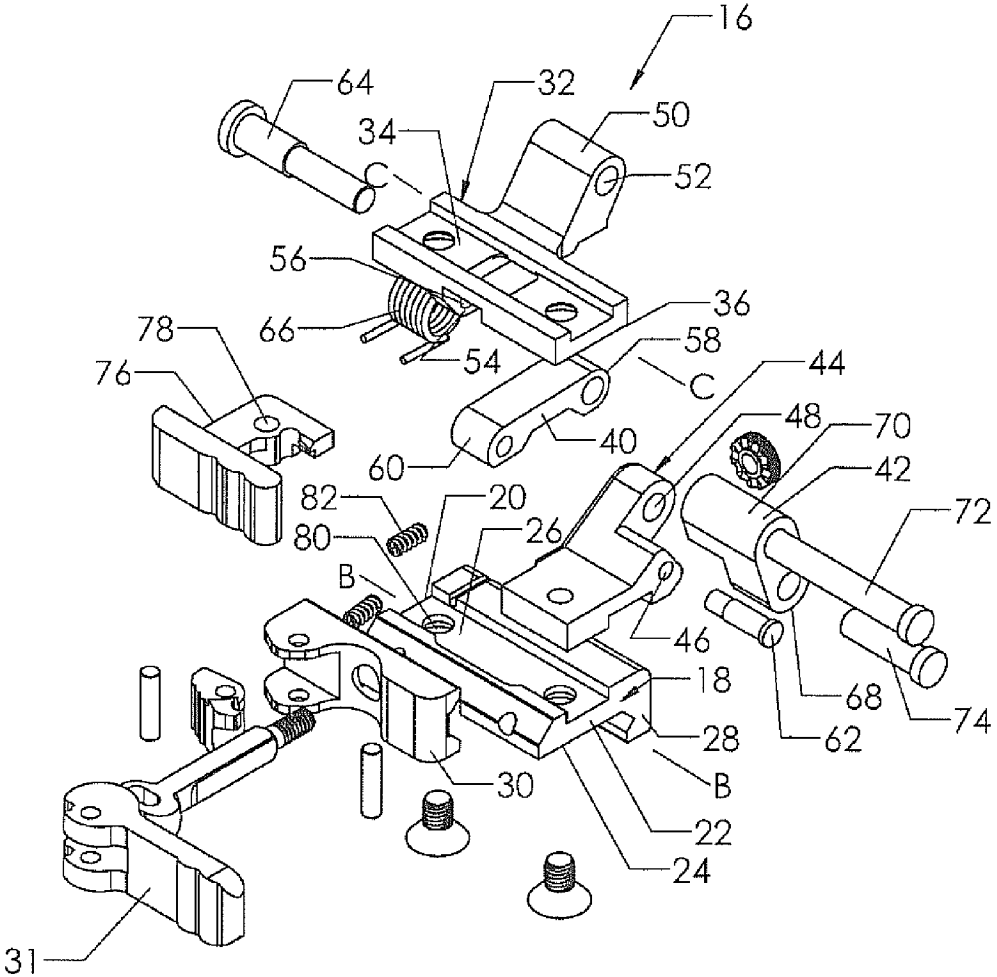
FIG. 8 is an exploded perspective view of the mount shown in FIGS. 1-7, showing the component pieces of the mount.

Referring now to FIGS. 4-8, the mount is shown generally at 16 without the accessory or rail. FIGS. 4 and 5 show the mount in the use position and FIGS. 6 and 7 show the month in the storage position. FIG. 8 shows an exploded view of the mount. Referring to FIGS. 4-8, the mount 16 includes a base portion 18. As illustrated, the base portion 18 has a lower surface that is configured to engage the rail 10 so as to attach the base portion thereto. The base portion 18 also has an opposed upper surface. The base portion has a forward edge 20 and a rearward edge 22 and may be said to have a fore-aft axis B that extends between the forward and rearward edges. When the base portion 18 is mounted on the rail 10, the fore-aft axis B is parallel to the longitudinal axis A of the rail 10.

Referring to FIG. 8, the mount will be described in more detail. The lower surface of the base portion 18 is labeled as 24 and the upper surface is labeled as 26. The fore-aft axis is shown at B. As will be clear to those of skill in the art, the base portion 18 may engage the rail in a variety of ways. In the illustrated embodiment, a quick connect design is provided. In this design, the base portion has a first side portion 28 and an opposite second side portion 30. The second side portion 30 in the illustrated embodiment is movable relative to the first side portion 28 so as to selectively grip the rail of the weapon. The second side portion 30 is moved into the gripping position by a cam lever 31. Other approaches for connecting the base portion to a rail may also be used.

The mount 16 further includes an upper portion 32. The upper portion has an upper surface 34 and an opposed lower surface 36. The upper surface 34 forms a mounting surface for receiving the accessory 14.

The upper portion 32 is illustrated in the use position in FIGS. 4 and 5 and in the storage position in FIGS. 6 and 7. The exploded view of FIG. 8 also shows the upper portion generally oriented as it would be in the use position. In the use position, the upper portion 32 is directly above the base portion 18. The lower surface 36 of the upper portion 32 may rest on the upper surface 26 of the base portion 18 in the use position so as to provide secure positioning and stability.

As best shown in FIG. 8, a pair of links 40 and 42 interconnect the base portion 18 and the upper portion 32 so as to allow the upper portion 32 to articulate between the use position of FIGS. 4 and 5 and the storage position of FIGS. 6 and 7. In the illustrated embodiment, the base portion 18, the upper portion 32 and the links 40 and 42 form a 4-bar linkage. As will be clear to those of skill in the art, the links and pivot positions in a 4-bar linkage may be chosen so as to provide a variety of articulation profiles.

As shown, the base portion 18 has a tab 44 extending therefrom, with the tab having several attachment holes defined therein. In this embodiment, the tab extends generally perpendicularly from the rest of the base portion above the first side portion 28. In this version, the tab 44 is a separate piece that connects to the remainder of the base portion. Alternatively, it may be integral therewith. The attachment holes may be referred to as pivot holes, since they define pivot axes for the links 40 and 42. A first pivot hole is shown at 46 and a second pivot hole is shown at 48. Each pivot hole extends parallel to the fore-aft axis B. The first pivot hole 46 is inboard of and below the second pivot hole 48.

The upper portion 32 also has a tab 50 extending generally perpendicularly therefrom. Tab 50 has a single pivot hole 52 defined therein, also extending parallel to the fore-aft axis B. The upper portion also has a small lower tab 54 that extends downwardly from the lower surface 36. A pivot hole 56 is defined in the lower tab 54, also parallel to the fore-aft axis B.

Link 40 has opposed first 58 and second 60 ends, each with pivot holes defined therethrough. Pivot pin 62 extends through the hole in the second end 60 of the link 40 and engages the hole 56 in the lower tab 54. Pivot pin 64 extends through a spring 66, extends through the hole in first end 58 of the link 40, and engages the first pivot hole 46 in the tab 44. As will be clear to those of skill in the art, the spring 66 is captured and engages the components of the mount so as to urge the mount to the storage position. Other biasing members may be used in other versions, while still other versions may lack a biasing member. As shown, the link 40 extends generally horizontally in the use position.

The link 42 has opposed first 68 and second 70 ends, each with pivot holes defined therethrough. Pivot pin 72 is shown engaging the pivot hole in the second end 70 of the link 42.

When assembled, the pivot pin 72 engages the pivot hole 52 in the tab 50 of the upper portion 32. Pivot pin 74 extends through the pivot hole in the first end 68 of the link 42 and engages the second pivot hole 48 in the tab 44 of the base portion 18. As shown, the link 42 extends generally upwardly and inwardly from its first end 68 to its second end 70.

Due to the relative lengths of the links 40 and 42, and the positions of the pivotal interconnections, the upper portion 32 articulates between a use position wherein it is generally horizontal and a storage position wherein it is moved to the side and angled downwardly with respect to the base portion 18, as best shown in FIGS. 6 and 7. As will be clear to those of skill in the art, the links may have different lengths and/or the pivot positions may be changed so as to provide a different storage position than illustrated. In some versions, the links have different lengths from each other, while in other versions the links may have the same length.

The upper portion 32 may be said to have a fore-aft axis C that is parallel to the fore-aft axis B in both the use and storage positions.

In the illustrated embodiment, the mount 16 further includes a latch 76 for latching the upper portion 32 in the use position. The latch 76 is pivotally interconnected with the base portion 18 so that it can be pivoted about an axis defined by hole 78 in the latch 76 and hole 80 in the base portion. Spring 82 bias the latch 76 into a position wherein it engages a tab on the lower surface of the upper portion 32, when the upper portion is in the use position. When the latch 76 is pushed, so as to rotate against the force of the spring 82, the latch disengages the tab on the upper portion 32, allowing it to move to the storage position.

Figure 10:
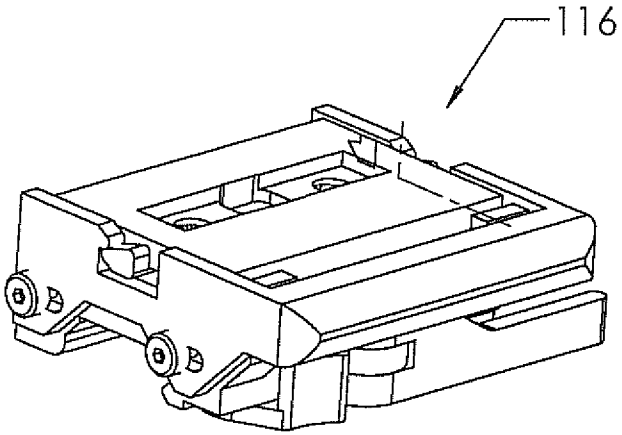
FIG. 10 is a perspective view of the mount of FIG. 9 from the opposite side.
Figure 9:
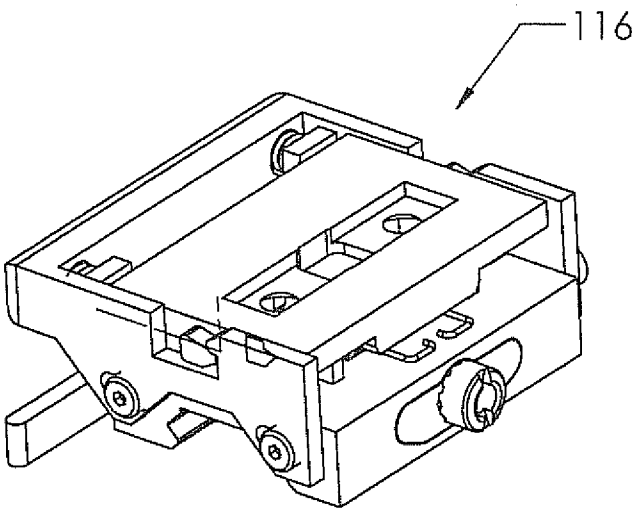
FIG. 9 is a perspective view of a second embodiment of a mount in accordance with the present, with the mount shown in a use position.
Figure 11:
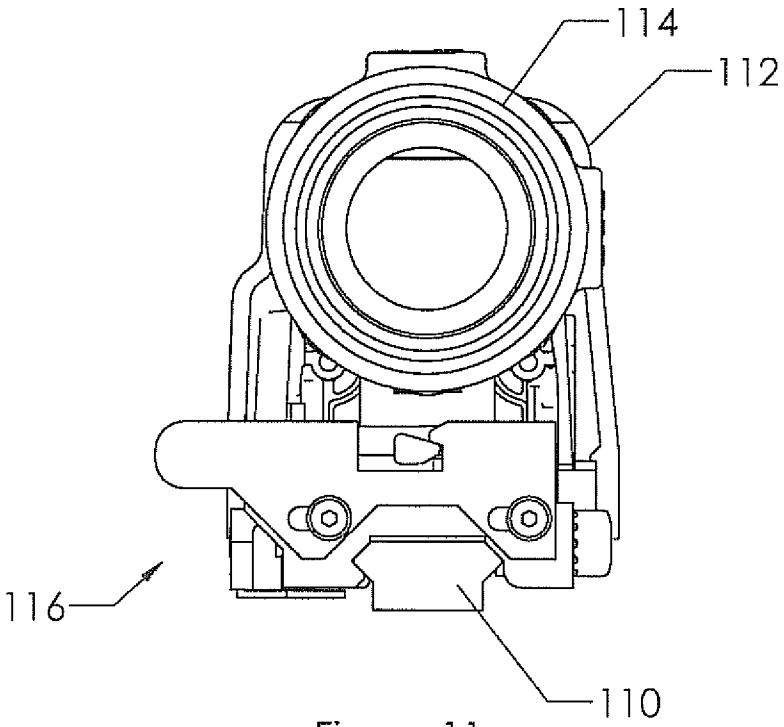
FIG. 11 is an end view of the mount of FIG. 9 on a rail with an accessory attached thereto, with the mount and accessory in the use position.
Figure 12:
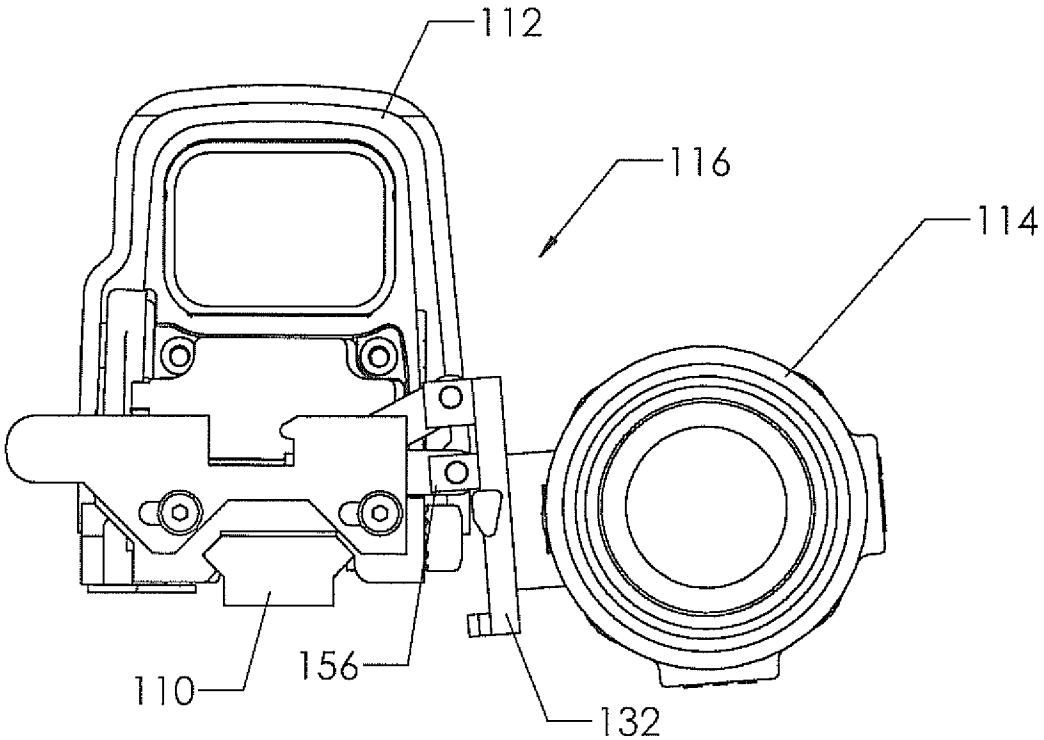
FIG. 12 is an end view of the mount and accessory of FIG. 11, with the mount and accessory in a storage position.
Figure 13:
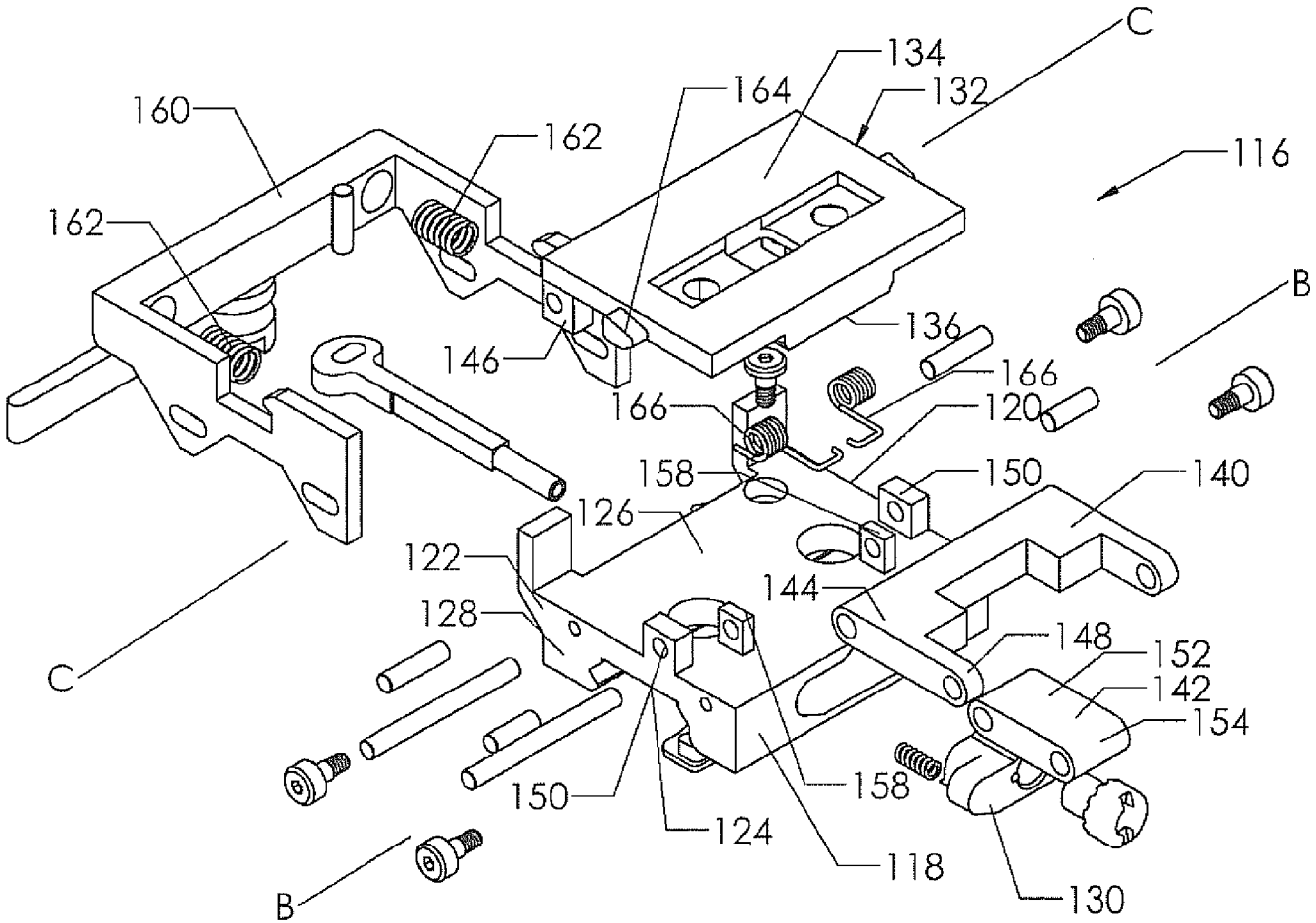
FIG. 13 is an exploded perspective view of the mount shown in FIGS. 9-12, showing the component pieces of the mount.

Referring now to FIGS. 9-13, a second embodiment of a mount is generally shown at 116. Also shown in FIGS. 11 and 12 is a sighting device 112 that is mounted to a rail 110. FIGS. 11 and 12 also show an accessory 114 mounted to the rail 110 by the second embodiment of the mount. FIG. 11 shows the mount and accessory in the use position and FIG. 12 shows the mount and accessory in the storage position. FIGS. 9 and 10 show the mount 116 without the rail or accessory. FIG. 13 provides an exploded view of the mount so as to illustrate its components.

Referring to FIG. 13, the mount 116 includes a base portion 118. As illustrated, the base portion 118 has a lower surface that is configured to engage the rail 110 so as to attach the base portion thereto. The base portion 118 also has an opposed upper surface. The base portion has a forward edge 120 and a rearward edge 122 and may be said to have a fore-aft axis B that extends between the forward and rearward edges. When the base portion 118 is mounted on the rail 110, the fore-aft axis B is parallel to the longitudinal axis of the rail.

The lower surface of the base portion 118 is labeled as 124 and the upper surface is labeled as 126. The fore-aft axis is shown at B. As will be clear to those of skill in the art, the base portion 118 may engage the rail in a variety of ways. In the illustrated embodiment, a quick connect design is provided. In this design, the base portion has a first side portion 128 and an opposite second side portion 130. The second side portion 130 in the illustrated embodiment is movable relative to the first side portion 128 so as to selectively grip the rail of the weapon.

The mount 116 further includes an upper portion 132. The upper portion has an upper surface 134 and an opposed lower surface 136. The upper surface 134 forms a mounting surface for receiving the accessory 114.

The upper portion 132 is illustrated in the use position in. FIGS. 9-11. In this position, the upper portion is directly above the base portion. The lower surface 136 of the upper portion 132 may rest on the upper surface 126 of the base portion 118 in the use position so as to provide secure positioning and stability.

As best shown in FIG. 13, a pair of links 140 and 142 interconnect the base portion 118 and the upper portion 132 so as to allow the upper portion 132 to articulate between the use position and the storage position. In the illustrated embodiment, the base portion 118, the upper portion 132 and the links 140 and 142 form a 4-bar linkage. As will be clear to those of skill in the art, the links and pivot positions in a 4-bar linkage may be chosen so as to provide a variety of articulation profiles. In the illustrated embodiment, the links 140 and 142 are elongated in a fore-aft direction. This provides for a stable interconnection between the base and upper portion of the mount.

The link 140 may be said to have two sides that are pivotally interconnected with the base and upper portion. The first side 144 of the link 140 is pivotally attached to tabs 146 on the upper portion 132. The second side 148 of the link 140 is pivotally interconnected with tabs 150 on the base portion. The effective length of link 140 is defined as the distance between the pivot axes defined by the pivotal interconnections at the opposed sides 144 and 148. The link 142 also has two opposed sides 152 and 154. The first side 152 is pivotally interconnected with the upper portion 132 using tabs 156, one of which is shown in FIG. 12. The second side 154 is pivotally interconnected with tabs 158 on the base 118. The effective length of link 142, defined as the distance between the pivot axes defined by the pivotal interconnections at the opposed sides 152 and 154, is shorter than the effective length of the link 140.

Due to the relative lengths of the links 140 and 142, and the positions of the pivotal interconnections, the upper portion 132 articulates between a use position wherein it is generally horizontal and a storage position wherein it is moved to the side and angles downwardly with respect to the base portion 118, as best shown in FIG. 12. This positions the accessory 114 more out of the way then if it only articulated to the side. As best shown in FIG. 4, with the upper portion 132 in the storage position, part of the upper portion extends below the base portion. As will be clear to those of skill in the art, the links may have different lengths and/or the pivot positions may be changed so as to provide a different storage position than illustrated.

The upper portion 132 may be said to have a fore-aft axis C that is parallel to the fore-aft axis B in both the use and storage positions.

In the illustrated embodiment, the mount 116 further includes a latch 160 for latching the upper portion 132 in the use position. The latch 160 is movably interconnected with the base portion 118 so that it can be moved side to side. Springs 162 bias the latch 160 into a position wherein it engages tabs 164 on the upper portion 132, when the upper portion is in the use position. When the latch 160 is pushed, so as to move against the force of the springs 162, the latch disengages the tabs 164 on the upper portion 132, allowing it to move to the storage position. In the illustrated embodiment, springs 166 bias the upper portion towards the storage position. In the illustrated embodiment, the latch 160 is generally C-shaped so as to engage both the front and the back of the upper portion 132, thereby reliably securing it in the use position. At the same time, it is only necessary to move one element, latch 160, to disengage both ends of the upper portion.

As will be clear to those of skill in the art, the herein illustrated and discussed embodiments of the present invention may be altered in various ways without departing from the scope or teaching of the present invention. It is the following claims, including all equivalents, which define the scope of the invention.

We claim:

1. A mount for mounting an accessory to a rail of a weapon, the rail defining a longitudinal axis and having an upper face and a pair of opposed side faces, the mount comprising:

a base portion having an upper surface and a lower surface, the lower surface configured to engage a rail of a weapon so as to attach the base portion thereto, the base portion having a forward edge and a rearward edge with a fore-aft axis extending therebetween, the fore-aft axis being parallel to the longitudinal axis of the rail when the base portion is attached to the rail;

an upper portion having an upper surface and a lower surface, the upper surface of the upper portion comprising a mounting surface for receiving an accessory;

a first and a second link interconnecting the upper portion and the base portion for articulation between a use position and a storage position, the upper portion in the use position being disposed above the base portion and the upper portion in the storage position being disposed to a side of the base portion, the upper portion having a forward edge and a rearward edge with a fore-aft axis extending therebetween, the fore-aft axis of the base portion and the fore-aft axis of the upper portion being parallel to one another in both the use position and in the storage position.

2. The mount in accordance with claim 1, wherein one of the links has an effective length longer than the effective length of the other link.

3. The mount in accordance with claim 1, wherein the upper portion is generally parallel to the base portion in the use position and is angled with respect to the base portion in the storage position.

4. The mount in accordance with claim 1, wherein part of the upper portion extends below the base portion when the upper portion is in the storage position.

5. The mount in accordance with claim 1, further comprising a locking element for locking the upper portion in the use position.

6. The mount in accordance with claim 5, wherein the locking element is a latch that engages a tab on the upper portion.

7. The mount in accordance with claim 6, wherein the latch is pivotally interconnected with the base portion.

8. The mount in accordance with claim 7, further comprising a spring for biasing the upper portion towards the storage position.

9. The mount in accordance with claim 1, further comprising a spring for biasing the upper portion towards the storage position.

10. The mount in accordance with claim 1, wherein:

the base portion has a first side portion configured to engage a first side face of a rail of a weapon and an opposite second side portion configured to engage a second side face of a rail of a weapon;

one of the side portions being movable relative to the other of the side portions such that the side portions cooperate to selectively grip the rail of the weapon.

11. A mount for mounting an accessory to a weapon, the mount comprising:

a base portion having an upper surface and a lower surface, the lower surface configured to attach to a weapon, the base portion having a forward edge and a rearward edge with a fore-aft axis extending therebetween, the fore-aft axis being generally parallel to a longitudinal axis of the weapon when the base portion is attached thereto;

an upper portion having an upper surface and a lower surface, the upper surface of the upper portion comprising a mounting surface for receiving an accessory;

a first and a second link interconnecting the upper portion and the base portion for articulation between a use position and a storage position, the upper portion in the use position being disposed above the base portion and the upper portion in the storage position being disposed to a side of the base portion.

12. The mount in accordance with claim 11, wherein the upper portion has a forward edge and a rearward edge with a fore-aft axis extending therebetween, the fore-aft axis of the base portion and the fore-aft axis of the upper portion being parallel to one another in both the use position and in the storage position.

13. The mount in accordance with claim 11, wherein the upper portion is generally parallel to the base portion in the use position and is angled with respect to the base portion in the storage position.

14. The mount in accordance with claim 11, wherein part of the upper portion extends below the base portion when the upper portion is in the storage position.

* * * * *